United States Patent [19]

Reinhard

[11] Patent Number: 5,056,542

[45] Date of Patent: Oct. 15, 1991

[54] APPARATUS FOR DISPENSING DETERGENT IN A WAREWASH MACHINE

[75] Inventor: Roger A. Reinhard, Greensboro, N.C.

[73] Assignee: Kay Chemical Company, Greensboro, N.C.

[21] Appl. No.: 486,426

[22] Filed: Feb. 28, 1990

[51] Int. Cl.[5] ..... A47L 15/44

[52] U.S. Cl. ..... 134/57 D; 222/651

[58] Field of Search ..... 134/56 D, 57 D, 58 D; 68/17 R; 222/651, 652

[56] References Cited

U.S. PATENT DOCUMENTS

| | | | |
|---|---|---|---|
| 2,254,269 | 9/1941 | Clark et al. | 134/57 D |
| 2,747,588 | 5/1956 | Bonner | 134/93 |
| 2,859,760 | 11/1958 | Borell | 134/57 D X |
| 2,946,489 | 7/1960 | Brucken | 222/651 X |
| 3,207,373 | 9/1965 | Dannenmann | 222/651 |
| 3,445,038 | 5/1969 | Booth et al. | 222/651 X |
| 3,680,784 | 8/1972 | Fakes | 134/57 D X |
| 3,771,333 | 11/1973 | Jurjans | 68/12 R |
| 3,876,117 | 4/1975 | Wright et al. | 222/651 |
| 3,982,666 | 9/1976 | Kleimola et al. | 222/651 |
| 4,009,801 | 3/1977 | Williams | 222/651 |
| 4,147,559 | 4/1979 | Fraula et al. | 134/57 D |
| 4,249,573 | 2/1981 | Chevallier | 134/58 D X |
| 4,285,352 | 8/1981 | McMahon et al. | 134/48 |
| 4,488,666 | 12/1984 | Herbst et al. | 222/651 |
| 4,832,064 | 5/1989 | Nezworski | 134/57 D X |
| 4,836,229 | 6/1989 | Lakhan et al. | 134/93 |

FOREIGN PATENT DOCUMENTS

| | | | |
|---|---|---|---|
| 2577128 | 8/1986 | France | 134/56 D |

*Primary Examiner*—Philip R. Coe

*Attorney, Agent, or Firm*—Finnegan, Henderson, Farabow, Garrett & Dunner

[57] ABSTRACT

A dispensing apparatus and method for dispensing detergent in a warewash machine. The rinse water spray systm or an alternate water source is monitored to determine if water is being supplied to the warewash machine. Once water is sensed being supplied to the machine, the apparatus determines whether the water is being supplied for a rinse cycle or a fill cycle. The amount of detergent dispensed is controlled based upon the determination of whether the water is being supplied in a rinse cycle or a fill cycle. If the apparatus determines that the water is being supplied for a rinse cycle, a make-up amount of detergent is dispensed upon completion of the rinse cycle. If the apparatus determines that the water is being supplied for a fill cycle, the washtank is pre-charged with the desired concentration of detergent during the fill cycle.

15 Claims, 9 Drawing Sheets

APPARATUS FOR DISPENSING DETERGENT IN A WAREWASH MACHINE

BACKGROUND OF THE INVENTION

1. Field of the Invention

The present invention relates to an apparatus and method for dispensing detergent in a warewash machine, and more particularly to a probeless apparatus and method for dispensing detergent in a warewash machine.

2. Description of the Related Art

The present invention relates to an apparatus and method for supplying detergent into a commercial warewash machine. Such commercial warewash machines typically include a washtank for holding a supply of wash water, a wash water spray head for supplying the wash water to a rack of wares to be cleaned, and a rinse water spray head for rinsing the cleaned rack of wares. The wash water in the washtank should maintain a predetermined concentration of detergent to ensure that the dishes are properly cleaned.

During the wash cycle, a wash pump draws water that contains detergent from the washtank and by means of the wash water spray head supplies the wash water over the wares. Subsequent to the wash cycle which typically takes 45 seconds, a dwell period is provided between the wash cycle and an ensuing rinse cycle to permit the wash water solution to drain off the wares. Next, a rinse cycle that typically takes 12–15 seconds occurs. The fresh water rinse is supplied through the rinse water spray head. Typically, 1.25–2.5 gallons of fresh water are introduced during the rinse cycle. Food soils are carried down an overflow drain in the washtank by water that is displaced by the additional fresh water added during the rinse cycle. Thus, each time the rinse cycle occurs a certain amount of detergent is lost down the overflow drain.

Consequently, it is necessary to replenish the detergent each time the rinse cycle occurs to ensure that the desired concentration of detergent in the washtank is maintained. Also, in commercial operations it is common to completely drain the washtank two or three times in a 24 hour period. Each time the washtank is drained, it is necessary to charge the fresh water introduced into the washtank with detergent to achieve the desired concentration of detergent in the wash water. The fresh water introduced to fill the washtank after a draining operation can be supplied through the rinse water spray head or through a separate water source.

Two types of systems exist for introducing detergent into the washtank of a warewash machine. The first type is a probe system which operates by means of a conductivity sensing probe mounted in the washtank. This probe, when connected to a conductivity controller, senses the conductivity of the wash water in the washtank. When the conductivity drops below an adjustable, preset level, the conductivity controller activates a chemical feed pump to introduce additional detergent into the washtank. This type of system continues to add detergent until the conductivity of the wash water in the washtank is at or above a preset level. Once the conductivity again drops below this preset level, the cycle repeats itself.

Although the probe systems are in common use in the industry, there are many drawbacks associated with such systems. For instance, factors other than the detergent concentration can affect the conductivity of the wash water in the washtank, thereby causing erroneous readings of the detergent concentration. Such factors include water hardness, water solids concentration, soil load and temperature. Also, mineral deposits such as limescale on the sensing probe can substantially reduce the accuracy of the system. Moreover, over extended periods of time, the set point of the sensing probe tends to vary. Finally, due to the number of factors that can affect the reading of the probe, the dispensing system cannot be calibrated prior to installation on a specific warewash machine. The inability to precalibrate the instrument complicates the installation process of the dispensing system.

A second known type of detergent dispensing system is referred to as a probeless system. Such systems are generally electro-mechanical in nature and typically include a variable speed peristaltic pump that is actuated by the rinse system of the warewash machine. This type of system adds detergent to the washtank of the warewash machine continuously during the entire rinse cycle.

Many problems exist with known probeless detergent dispensing systems. For example, such systems compensate only for the detergent lost during the rinse cycle. These systems do not compensate for the draining and refilling of the washtank and are not capable of precharging a newly filled washtank with the desired concentration of detergent prior to washing the first rack of wares. To compensate for the inability to pre-charge the washtank, the amount of detergent added during each rinse cycle is increased. This allows the system to compensate for its lack of pre-charge capability. However, the result is that the system provides an inadequate concentration of detergent for the first several wash cycles and an over-concentration of detergent for the remainder of the wash cycles. Also, because the detergent is introduced during the rinse cycle when fresh water is being added to the washtank, a portion of the newly introduced detergent is immediately carried by the rinse water down the overflow drain before it has an opportunity to disperse into the wash water. Thus, a certain amount of detergent is lost before it can be utilized.

Accordingly, it is an object of the present invention to provide an apparatus for dispensing a make-up amount of detergent after the rinse cycle has been completed.

It is another object of the present invention to provide a detergent dispensing system that can pre-charge a washtank with a desired concentration of detergent.

It is yet another object of the present invention to provide an apparatus that can distinguish between a rinse cycle and a fill cycle and add the correct amount of detergent based upon such a determination.

Still another object is to provide an apparatus and a method for dispensing detergent into a warewash machine that are economical and efficient, both in the cost of the apparatus and in the use of detergent.

Additional objects and advantages of the invention will be set forth in the description which follows, and in part will be obvious from the description, of may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the invention as embodied and broadly described herein, there is provided an apparatus for dispensing detergent in a warewash machine including a washtank for holding a supply of wash water, a rinse water spray head through which water is supplied in a rinse cycle and a fill cycle, and a flow control means for controlling the flow of water being supplied. The apparatus comprises a means, coupled with the flow control means, for determining whether the water is being supplied in a fill cycle or a rinse cycle. Means are provided for dispensing detergent to the washtank of the warewash machine. A first control means is provided for operating the dispensing means to dispense a first predetermined amount of detergent. The first control means is activated in response to a determination that water is being supplied in a fill cycle. A second control means is provided for operating the dispensing means to dispense a second predetermined amount of detergent. The second control means is activated in response to a determination that water is being supplied in a rinse cycle. Preferably, the second predetermined amount of detergent is dispensed to the washtank after the rinse cycle is complete.

In another aspect of the present invention, an apparatus is provided for dispensing detergent into a warewash machine including a washtank for holding a predetermined supply of wash water introduced during a fill cycle, a rinse water spray head for spraying water over a rack of wares and into the washtank during a rinse cycle, and an overflow drain for draining excess water introduced into the washtank during a rinse cycle. The apparatus comprises a means for determining whether the water is being supplied to the washtank during a fill cycle or a rinse cycle. Means are provided for dispensing detergent to the washtank of the warewash machine. A first control means, coupled with the determining means and the dispensing means, causes the dispensing means to dispense a first predetermined amount of detergent during or after a fill cycle. A second control means, coupled with the determining means and the dispensing means, causes the dispensing means to dispense a second predetermined amount of detergent after the rinse cycle to compensate for the detergent drained from the washtank during the rinse cycle. Preferably, the second predetermined amount of detergent is substantially less than the first predetermined amount of detergent.

In yet another aspect of the present invention, there is provided a method of dispensing detergent into a warewash machine including a washtank for holding a supply of wash water and a rinse water spray head through which water is supplied in a rinse cycle and in a fill cycle. The method comprises the step of monitoring the rinse water spray system to sense water being supplied to the warewash machine. Next, the apparatus determines whether the water is being supplied in a fill cycle or a rinse cycle. Detergent is dispensed to the washtank of the warewash machine. The amount of detergent dispensed is controlled based upon a determination of whether the water is being supplied in a fill cycle or a rinse cycle.

In still another aspect of the present invention, there is provided a method of dispensing detergent into a warewash machine including a washtank for holding a supply of wash water, a rinse water spray head through which water is supplied over a rack of wares to the washtank during at least the rinse cycle, and an overflow drain for draining excess water introduced into the washtank. The method comprises the steps of sensing the flow of water into the washtank and determining whether the water is being introduced into the washtank in a fill cycle or a rinse cycle. A supply of water sufficient to fill the washtank is introduced into the washtank during a fill cycle. Also during the fill cycle, a first supply of detergent is introduced into the washtank that is sufficient to charge the water introduced into the washtank during the fill cycle. During the rinse cycle, a supply of water sufficient to rinse wares is introduced into the warewash machine. The excess water introduced into the warewash machine is drained through the overflow drain. After each rinse cycle, a second supply of detergent that is sufficient to fully charge the wash water is introduced into the washtank. Preferably the second supply of detergent is substantially less than the first supply of detergent.

BRIEF DESCRIPTION OF THE DRAWINGS

The accompanying drawings, which are incorporated in and constitute a part of the specification, illustrate a preferred embodiment of the invention and, together with the general description provided above and the detailed description of the preferred embodiment provided below, serve to explain the principles of the invention.

FIG. 4 illustrates a warewash machine at rest in a filled condition;

FIG. 5 illustrates a warewash machine during a wash cycle;

FIG. 6 illustrates a warewash machine during a dwell period between a wash cycle and a rinse cycle;

FIG. 7 illustrates a warewash machine during a rinse cycle; and

FIG. 8 illustrates a warewash machine during a fill cycle.

DESCRIPTION OF THE PREFERRED EMBODIMENTS

Reference will now be made to the present preferred embodiment of the invention that is illustrated in the accompanying drawings. The apparatus and method of the present invention can be installed on a warewash machine in which the fresh water fill operation is done through the rinse system. Alternatively, the apparatus of the present invention can be installed on a warewash machine that utilizes separate sources of water for the fill cycle and for the rinse cycle.

Figure 4:
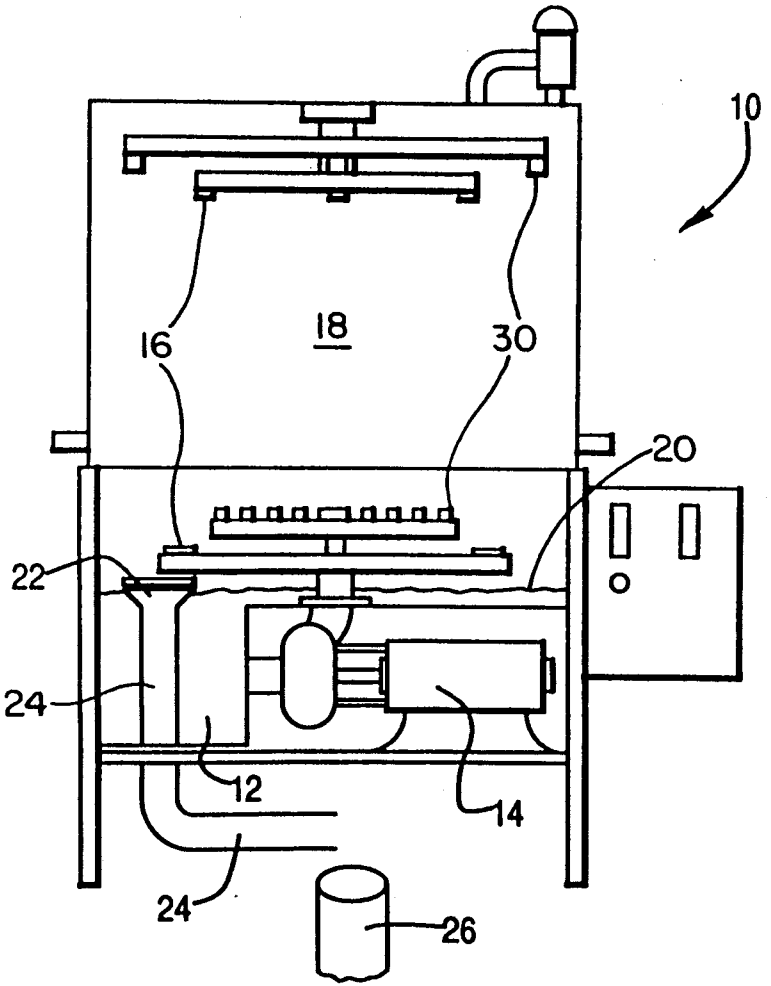

FIGS. 4 through 8 illustrate a cycle of operation in a typical warewash machine on which the apparatus of the present invention is intended to be installed. FIG. 4 illustrates a warewash machine indicated generally by the reference numeral 10 that includes a washtank 12. A wash pump 14 is disposed in washtank 12 to draw water therefrom and supply the water through wash spray head 16 over a rack of wares (not shown) that is disposed in upper cabinet 18. When warewash machine 10 is at rest as shown in FIG. 4, the water level 20 is positioned just below overflow drain intake 22 that is connected by drain pipe 24 to overflow drain 26.

Figure 5:
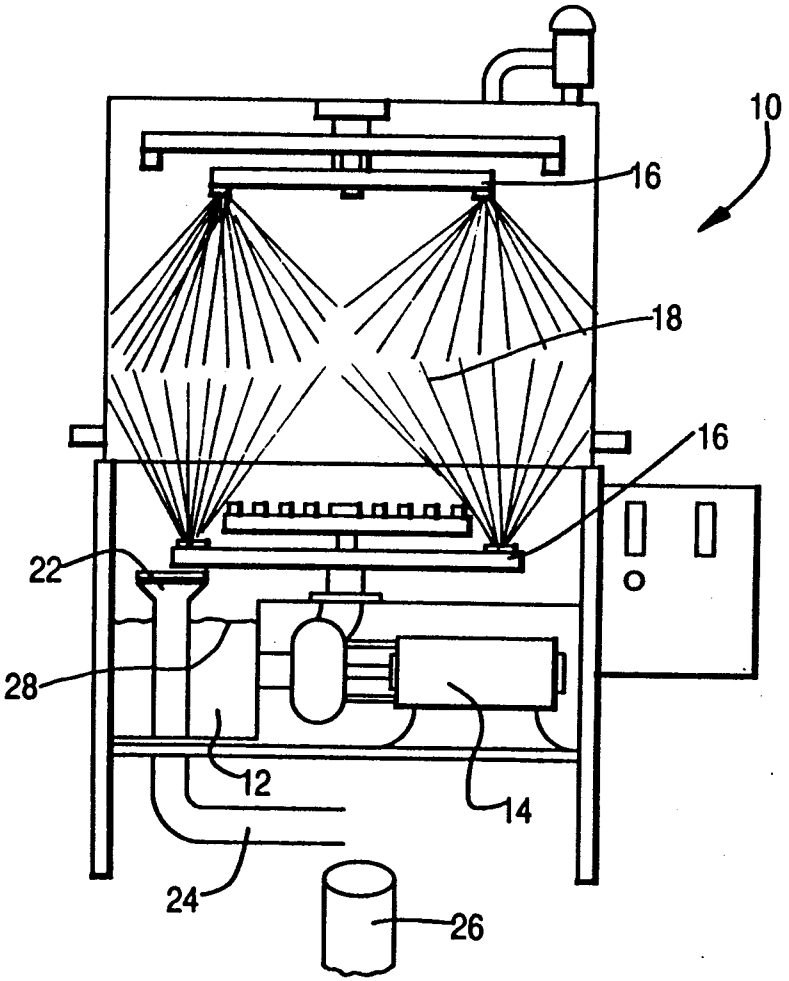
FIGS. 4–8 illustrate the cycle of events in a warewash machine on which the apparatus of the present invention is installed. More specifically.

FIG. 5 illustrates warewash machine 10 during a wash cycle which typically takes 45 seconds. During such a wash cycle, water is supplied through wash spray head 16 to a rack of wares positioned in upper cabinet 18. The wash water drawn from washtank 12 and supplied through wash spray head 16 results in a reduced water level 28 in washtank 12.

Figure 6:
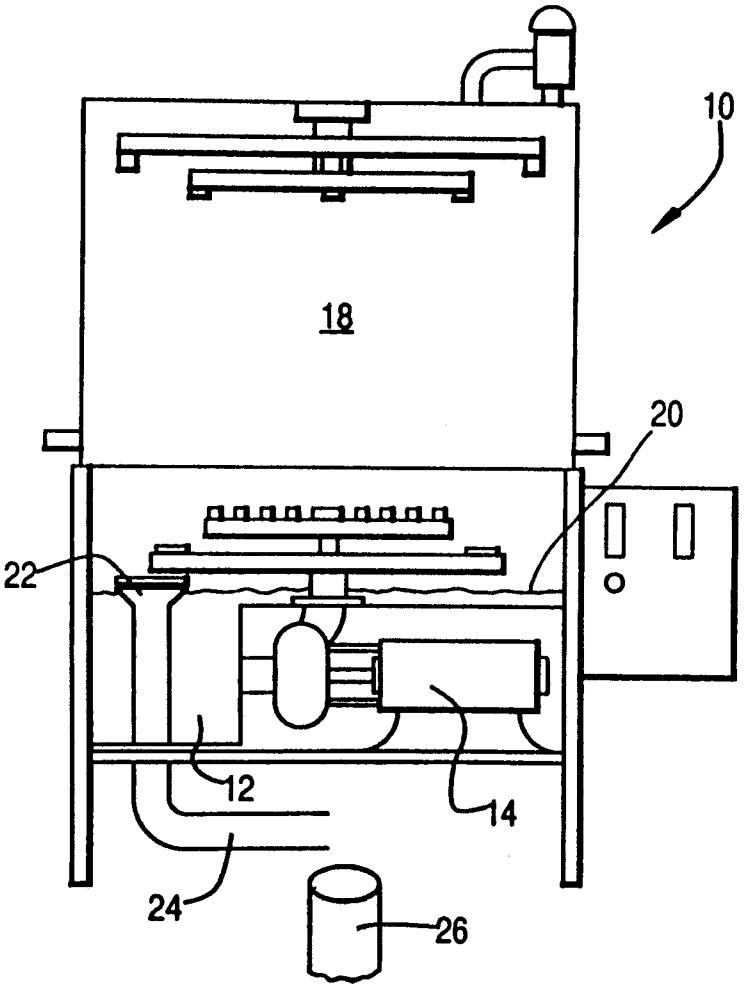

FIG. 6 illustrates warewash machine 10 during a dwell cycle that occurs between a wash cycle and a rinse cycle. The dwell cycle typically takes about 3 seconds. During the dwell cycle, the wash water solution drains off the wares in upper cabinet 18 into washtank 12 to return the water level 20 to substantially that shown in FIG. 4. A minor amount of wash water is lost through spillage and evaporation.

Figure 7:
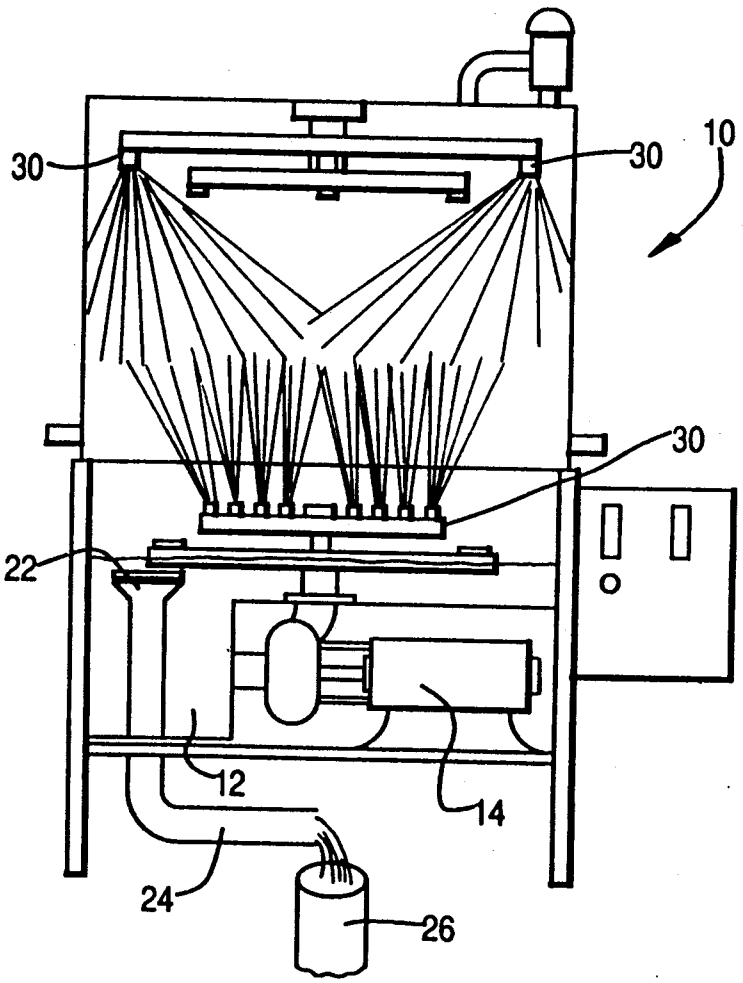

FIG. 7 illustrates warewash machine 10 during a rinse cycle that typically takes about 12 seconds to about 15 seconds. During the rinse cycle, approximately 1.5 to 2.5 gallons of fresh water are introduced through rinse water spray head 30 to a washed rack of wares positioned in upper cabinet 18. The purpose of the rinse cycle is threefold. First, it rinses the remaining soil off the wares with fresh water. Second, in high rinse temperature machines, it sanitizes the wares with fresh water heated to at least 180° F. Third, it carries food soil down overflow drain 26 by displacing an equivalent volume of water to that supplied in the rinse cycle. In addition to food soils being carried down the overflow drain 26, water containing the detergent is also carried down overflow drain 26.

Figure 8:
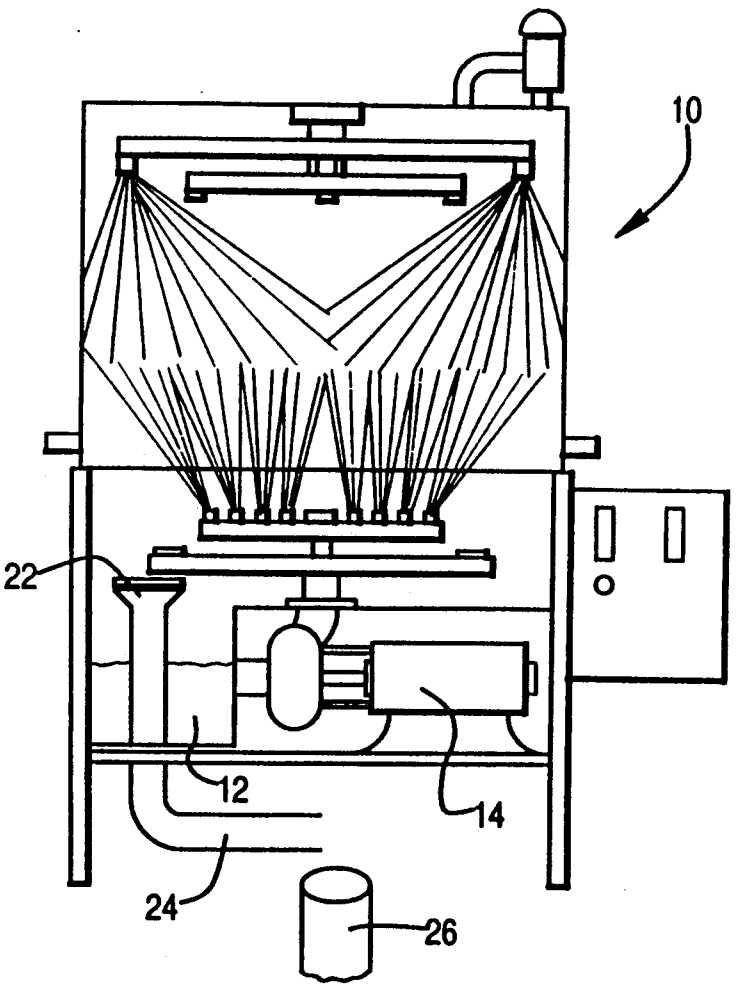

FIG. 8 illustrates warewash machine 10 during a fill cycle. In warewash machine 10 depicted in FIG. 8, the fresh water fill occurs through rinse water spray head 30. Alternatively, a fresh water fill may be provided through a separate water source (not shown). When washtank 12 is filled to water level 20, a float switch (not shown) terminates the fresh water fill operation.

Figure 1:
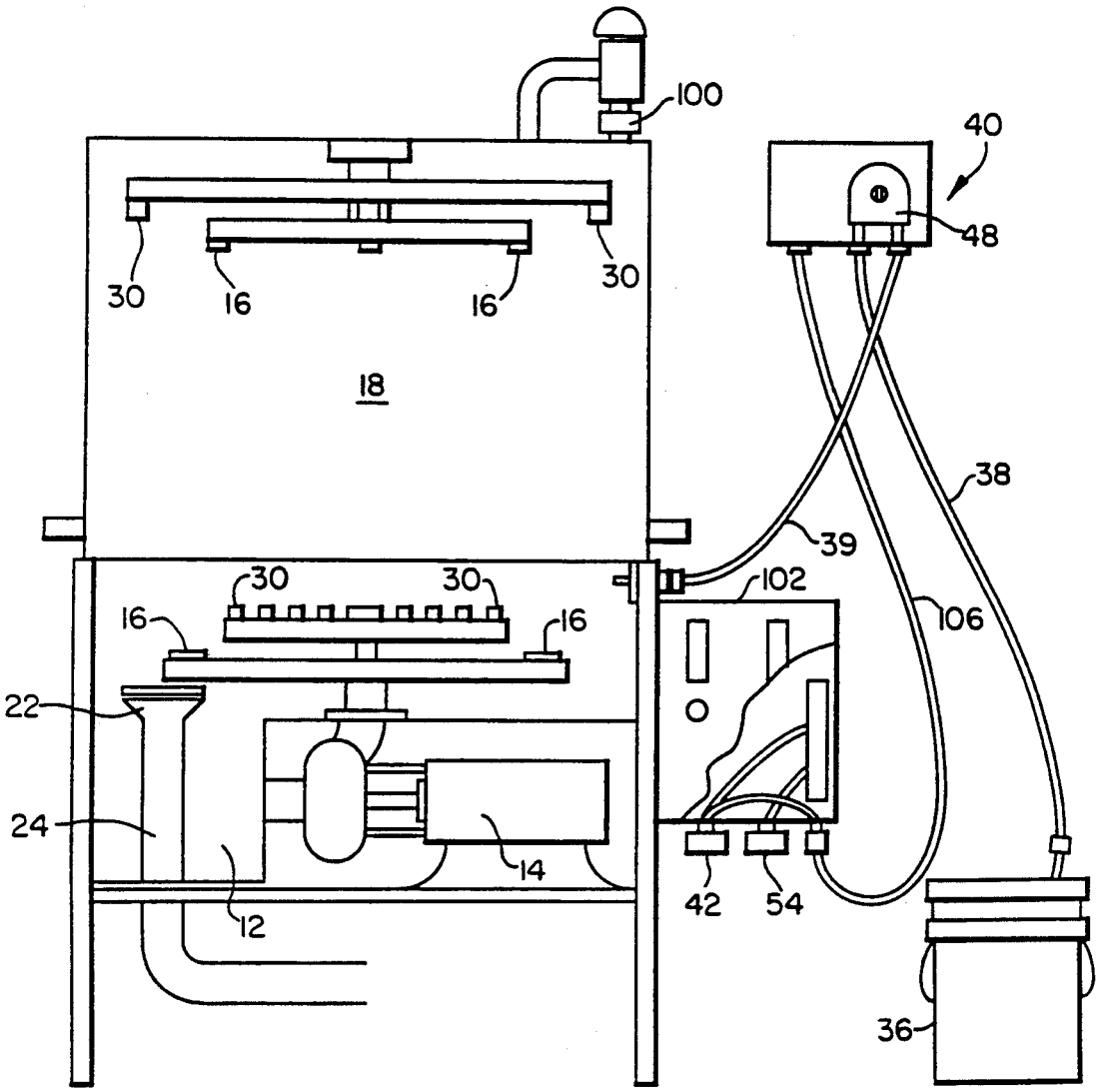
FIG. 1 is a diagram illustrating elements of the present invention and the connections between the apparatus of the present invention and a warewash machine.

A description of the dispensing apparatus and method of the present invention will now be provided with reference to the warewash machine described in connection with the figures. In accordance with the present invention, an apparatus is provided for dispensing detergent in a warewash machine that includes a washtank for holding a supply of wash water, a rinse water spray head through which water is supplied in a rinse cycle and in a fill cycle, and a flow control means for controlling the flow of water being supplied. As embodied herein and as shown in FIG. 1, a dispensing apparatus indicated generally by the reference numeral 40 dispenses detergent in warewash machine 10 that includes washtank 12 for holding a supply of wash water, rinse water spray head 30 through which water is supplied in a rinse cycle and a fill cycle, and solenoid valve 100 for controlling water flow into the machine. The control circuitry of warewash machine 10 provides a signal to open solenoid valve 100.

The dispensing apparatus includes a container 36 for holding a supply of liquid detergent and a peristaltic pump 48 for pumping detergent into the washtank. Tubing 38 connects the container 36 with the pump 48, and tubing 39 connects the pump to the washtank. The apparatus also includes a control system for operating the pump. The control system includes electronic control elements enclosed in rear panel 102, speed control 70 for the pump motor, and wiring, such as wiring 106 interconnecting the various electric sensing and control elements.

Figure 1A:
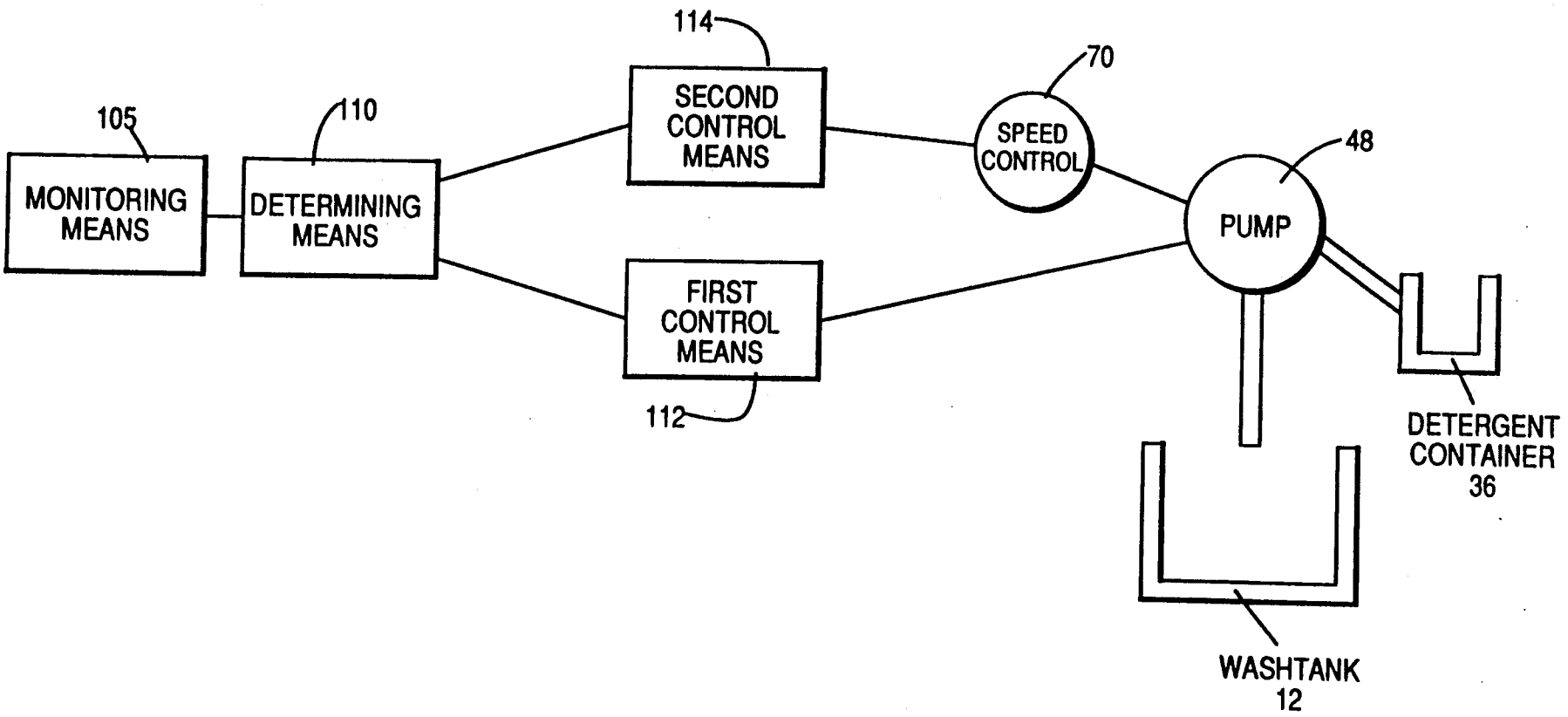
FIG. 1A is a schematic flowchart illustrating the major components of the present invention and their relationship.
Figure 2:
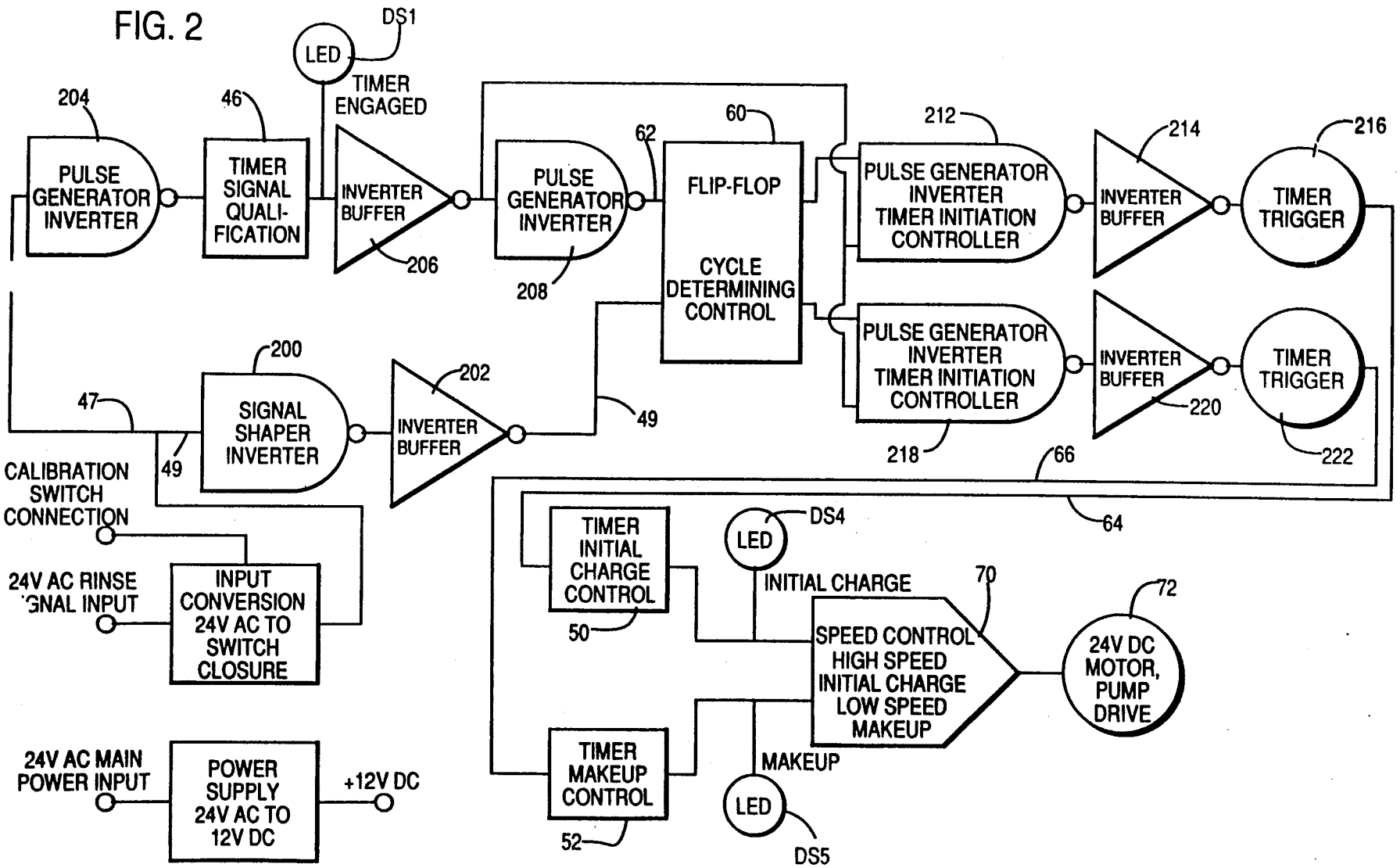
FIG. 2 is a logic flowchart illustrating the operation of the apparatus of the present invention.
Figure 3A:
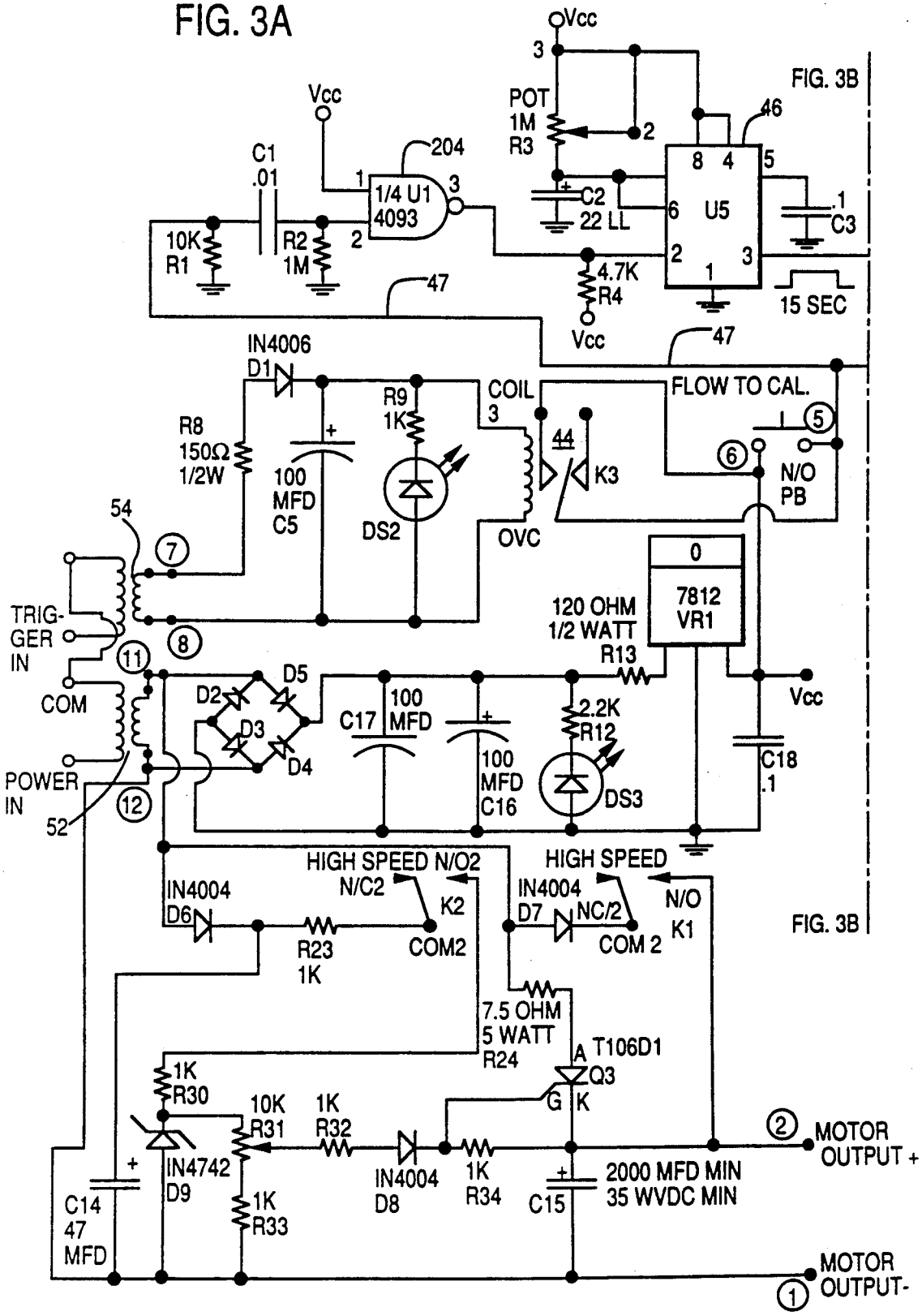
FIG. 3 is an electrical schematic diagram of the control circuit of the apparatus of the present invention.
Figures 3A, 3B:
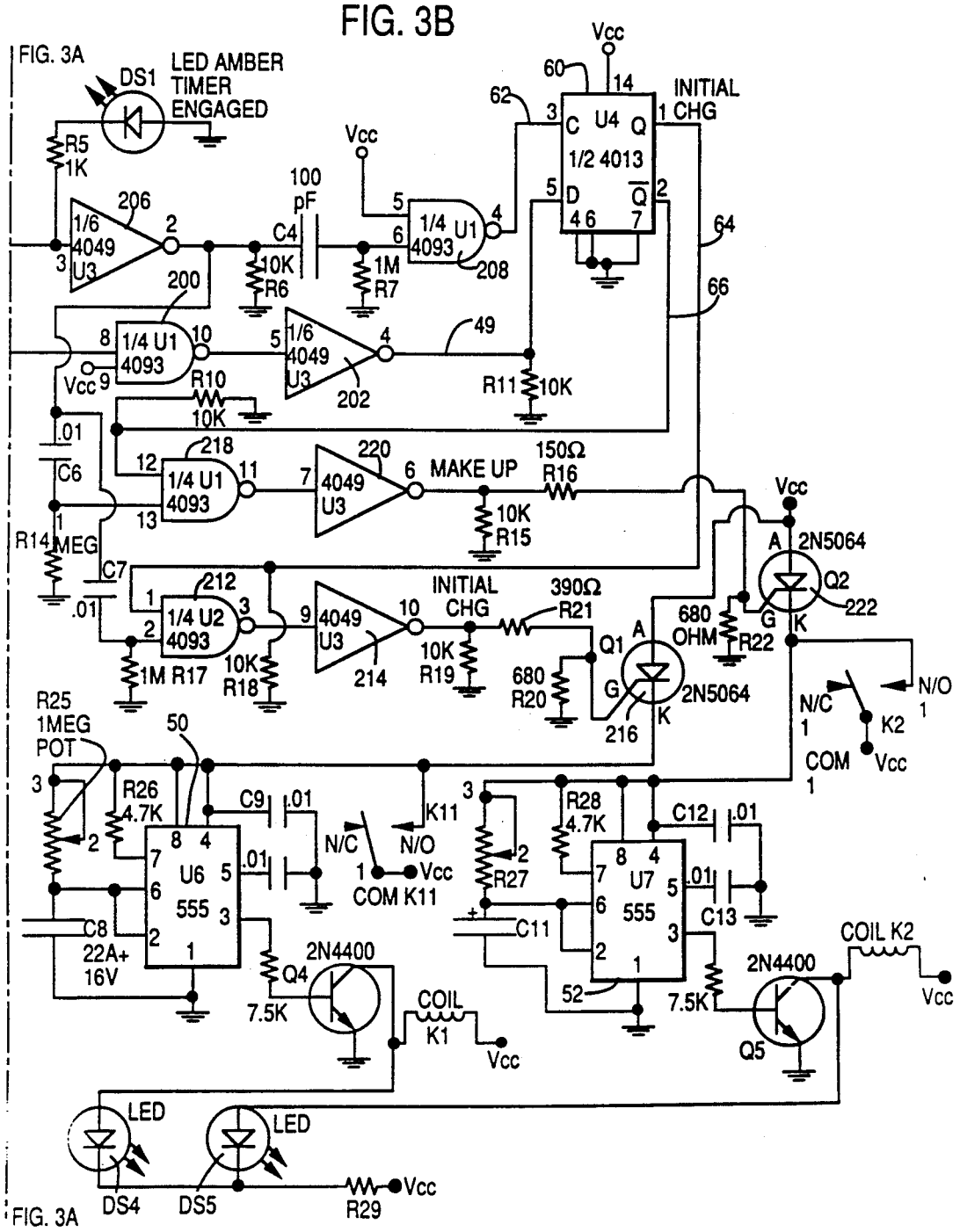

As shown generally in FIG. 1A, the warewash machine includes a means 105 for controlling the flow of water being supplied. Means 105 includes solenoid valve 100 and the signal provided by the control circuitry of warewash machine 10. A determining means 110 determines whether water is being supplied in a fill cycle or a rinse cycle. Also included in the dispensing apparatus is a first control means 112 for operating the pump 48 to dispense a first predetermined amount of detergent into the washtank 12 and a second control means 114 for operating the pump 48 to dispense a second predetermined amount of detergent into the washtank 12. The second control means preferably includes a speed control 70 for changing the speed of the motor for pump 48. The specific electrical elements of the preferred embodiment of the present invention are illustrated in FIGS. 2 and 3. A more detailed explanation of these elements and their operation is set forth below.

In the preferred embodiment, the operating electrical power and certain control signals for dispensing apparatus 40 are provided by warewash machine 10. Preferably, dispensing apparatus 40 operates by 24 volt AC power. This power source is actuated by the master power switch (not shown) of warewash machine 10. If 24 volts AC is not available, a step down transformer 42 (shown in FIG. 1) converts the input voltage to 24 volts AC.

Preferably, the supply to rinse water spray head 30 includes a solenoid valve 100 that controls the flow of water. A control signal is provided by the warewash machine to open solenoid valve 100. The solenoid valve preferably is positioned at a location between the supply pipe to the rinse water spray head and the spray head, or at the spray head. In the embodiment shown, the solenoid valve 100 is positioned at an inlet pipe immediately ahead of the spray head 30.

In accordance with the present invention, means are provided for determining whether the water is being supplied in a fill cycle or a rinse cycle. The determining means is activated in response to the control signal provided to solenoid valve 100 to supply water through the rinse water spray head. As embodied herein, the determining means includes a relay switch 44 (also designated by "K3" in FIG. 3) that is activated by the control signal provided to the valve 100 at rinse water spray head 30. With reference to FIGS. 2 and 3, relay switch 44 generates a signal through lines 47 and 49, respectively, when activated by the control signal. It is contemplated that means other than relay switch 44 can be utilized to sense a control signal provided to the solenoid valve in the rinse water spray head. By means of example only, such other means include an opto-isolator/optocoupler and a solid state relay. It is also contemplated that the control signal could be provided by other means, such as a pressure responsive switch provided in the rinse water spray system. Thus, it is possible for the determining means to be responsive to an electrical signal or to the flow of water.

In the embodiment shown, the control signal provided to switch 44 is 24 volts. If the control signal exceeds 24 volts, a step down transformer 54 is provided to reduce the control signal to 24 volts. Preferably, step down transformers 42 and 54 have a current rating greater than 35 VA.

As embodied herein, the determining means further includes an operation determination timer 46 (also designated by "U5" in FIG. 3) that receives the signal through line 47 from relay switch 44. Operation determination timer 46 is activated upon receipt of the signal through line 47 and generates a delayed signal after a predetermined time has elapsed. Operation determination timer 46 has an adjustable time range of 0 to 30 seconds. The predetermined time is a period greater than the typical 12 to 15 second rinse cycle. Preferably, the predetermined time is in the range of about 10 seconds to about 20 seconds.

The determining means further includes comparator means for receiving the signal generated by relay switch 44 through line 49 and the delayed signal provided through line 62 from operation determination timer 46. Preferably, a flip-flop circuit 60 (also designated by "U4" in FIG. 3) receives the signal through line 49 and the delayed signal. Flip-flop circuit 60 is a No. 4013 Dual-D type flip-flop integrated circuit. It is contemplated, however, that other means can be utilized to receive the signal from the relay switch and the delayed signal and perform the function of flip-flop circuit 60.

In accordance with the present invention, the apparatus includes means for dispensing detergent to the washtank of the warewash machine. As embodied herein, a peristaltic pump 48 is provided to supply detergent to washtank 12. With reference to FIG. 1, pump 48 draws detergent from container 36 through input tubing 38 and supplies the detergent through output tubing 39 to washtank 12. Preferably, pump 48 is a variable speed pump capable of supplying 7 to 10 ounces/minutes at ten to fifteen psi operating at 80 to 90 rpm. It is contemplated that a diaphragm type, piston type, or bellows type pump can also be utilized to dispense detergent to the washtank 12 of warewash machine 10.

In accordance with the present invention, a first control means for operating the dispensing means to dispense a first predetermined amount of detergent is provided. The first control means is activated by the determining means in response to a determination that water is being supplied in a fill cycle. As embodied herein, the first control means 112 includes a pre-charge timer 50 (also designated by "U6" in FIG. 3) for operating peristaltic pump 48 for a first predetermined amount of time to pre-charge washtank 12 with the first predetermined amount of detergent. Flip-flop circuit 60 generates a first control signal through line 64 to pre-charge timer 50 at times when relay switch 44 is providing a signal to flip-flop circuit 60 after the predetermined time has elapsed. The first predetermined amount of detergent is dispensed during or after a fill cycle and typically consist of about 20 milliliters to about 200 milliliters of detergent.

In accordance with the present invention, the apparatus includes second control means for operating the dispensing means to dispense a second predetermined amount of detergent. The second control means is activated by the determining means in response to the determination that water is being supplied in a rinse cycle. As embodied herein, the second control means 114 includes a make-up timer 52 (also designated by "U7" in FIG. 3) operatively connected to peristaltic pump 48 for operating the pump for a second predetermined period of time to add make-up detergent to washtank 12. Flip-flop circuit 60 generates a second control signal through line 66 to make-up timer 52 at times when relay switch 44 is not providing a signal to flip-flop circuit 60 after the predetermined time has elapsed. Preferably, the second predetermined amount of detergent is dispensed after the rinse cycle is complete and typically consists of 5 milliliters of detergent.

In a preferred embodiment of the present invention, the means for dispensing detergent to the washtank includes a means for controlling the speed of the pump when adding detergent after a rinse cycle. The means for controlling the speed of the pump includes a standard DC motor speed control circuit identified generally in FIGS. 1A and 2 with reference numeral 70 and shown in detail in FIG. 3. Speed control circuit 70 adjusts the speed of pump motor 72 when operated by make-up timer 52. Preferably, pump motor 72 is a 24V DC gear motor.

The present invention can also be applied to a warewash machine utilizing a water source other than the rinse water spray head for the fill operation. In such a machine, separate valves may be provided to control water flow in the rinse water spray head during a rinse cycle and in the alternate water source during a fill operation. The separate valves could each be provided separate control signals which could activate either the first control means 112 (for a fill cycle) or the second control means 114 (for a rinse cycle).

The present invention contemplates utilizing a single pump, such as pump 48, for dispensing detergent to the washtank during or after a fill cycle and after a rinse cycle. The pump is activated through a first timer to dispense a first predetermined amount of detergent during or after a fill cycle and is activated through a second timer to dispense a second predetermined amount of detergent to compensate for the detergent drained from the washtank during a rinse cycle. Preferably, the second predetermined amount of detergent is substantially less than the first predetermined amount of detergent.

The present invention provides a method of dispensing detergent in a warewash machine that includes a washtank for holding a supply of wash water and a rinse water spray head through which water is supplied in a rinse cycle and in a fill cycle. In accordance with the present invention, the method includes the step of monitoring the condition of the rinse water spray system to sense water being supplied to the warewash machine. Preferably, the step of monitoring the rinse water spray system includes sensing a control signal to a valve positioned in the rinse water spray system.

The method of the present invention also includes the step of determining whether the water is being supplied to the warewash machine in a fill cycle or a rinse cycle. As embodied herein, the step of determining whether the water is being supplied in a rinse cycle or a fill cycle includes sensing the control signal to the valve continuously for a predetermined period of time after the control signal was initially sensed by switch 44. Preferably, the predetermined amount of time is about 18 seconds to about 20 seconds.

In addition, the method of the present invention includes the step of dispensing detergent to the washtank of the warewash machine. As embodied herein, the step of controlling the amount of detergent dispensed includes dispensing a first amount of detergent in response to a first electrical signal generated by the determining means and dispensing a second amount of detergent in response to a second electrical signal generated by the determining means. The first electrical signal is generated when it is determined that a rinse cycle is occurring and the second electrical signal is generated when it is determined that a fill cycle is occurring.

During a fill cycle, a supply of water sufficient to fill the washtank is introduced into the washtank, along with a first supply of detergent sufficient to charge the water supplied into the washtank with a desired concentration. Because the desired concentration of detergent, the water volume capacity of the washtank, and the feed rate of the pump are all known prior to installation of the dispensing system, the timer that operates the detergent feed pump can be preset by the manufacturer prior to installation. This simplifies the installation process by eliminating the need for pre-charge calibration during installation. Also, the make-up timer can be preset by the manufacturer. Any adjustment to the amount of make-up detergent added after each rinse cycle ca be made by adjusting the speed control circuit 70.

During the rinse cycle, a supply of water sufficient to rinse wares in the warewash machine is provided. This rinse water drains off the wares in upper cabinet 18 of warewash machine 10 and enters washtank 12. The rinse water supplied in the rinse cycle raises the water level above overflow drain intake 22 and the excess water added during the rinse cycle flows out through overflow drain 26. After each rinse cycle is complete, a second supply of detergent is added to fully charge the water in the washtank to the desired concentration. Because the second supply of detergent is added after the rinse cycle is complete, the detergent is not lost down the overflow drain before it disperses into the wash water.

The logic flowchart of FIG. 2 and the electrical schematic diagram of FIG. 3 have been included to provide a more detailed understanding of the preferred embodiment of the apparatus and method of the present invention. The flowchart and diagram shown in detail a preferred embodiment and are readily understandable to one of ordinary skill in the art. Therefore, the discussion regarding these elements and their operation will present an overview.

With reference to FIG. 3, the power supply for the dispensing apparatus is provided through terminals 11 and 12 and applied to diodes D2, D3, D4, and D5 which form a full wave bridge. DS3 is an LED that indicates power being supplied to the apparatus.

The control signal is provided to the solenoid valve at the rinse water spray head or the alternate water source and to terminals 7 and 8 shown in FIG. 3. Resistor R8, diode D1, and capacitor C5 provide approximately 12 volts DC power to energize the coil of relay switch 44 (also designated as "K3"). LED DS2 indicates when the control signal from the valve is present.

When the 24 volt AC signal is applied to terminals 7 and 8, the coil of relay switch K3 (reference numeral 44) is energized, thereby closing the normally open contacts. Once the contacts close, power is fed to pin 8 of U1 (reference numeral 200). Pins 8 and 10 of U1 debounce the relay closure of K3 and supply a logic 0 signal to terminal 5 of U3 (reference numeral 202). Terminal 4 of U3 then supplies a logic 1 signal to terminal 5 of the flip-flop U4 (reference numeral 60).

At the same time, the signal from relay switch K3 is applied to pin 2 of U1 (reference numeral 204) to initiate operation determination timer U5 (reference numeral 46). LED DS1 indicates when timer U5 is engaged. At the completion of the timing cycle of U5, a logic 1 signal is applied through U3 (reference number 206) and U1 (reference numeral 208) to pin 3 of flip-flop circuit U4. If, at the end of the timing cycle of U5, pin 5 of U4 is at logic 1 (indicating water is still being supplied through the rinse system) then the output of pin 1 of U4 is at logic 1. Conversely, if at the end of the time cycle of U5, pin 5 of U4 is at logic 0 (indicating water is no longer being supplied) then the output of pin 2 of U4 is at logic 1. Thus, the output of pins 1 and 2 of flip-flop U4 depends on whether water is still being supplied to the warewash machine when the operation determination timer U5 ceases operation.

The outputs of pins 1 and 2 of U4 determine whether the pre-charge timer U6 (reference numeral 50) or the make-up timer U7 (reference numeral 52) operates pump 48. If a logic 1 signal is provided by output pin 1 of U4, then timer U6 controls pump motor 72. The control signal is provided to timer U6 via line 64 through U2 (reference numeral 212), U3 (reference numeral 214) and Q1 (reference numeral 216). LED DS4 indicates that timer U6 is in operation.

If output pin 2 of U4 provides a logic 1 output signal, then timer U7 operates pump motor 72. A logic 1 output signal from pin 2 of U4 closes the two sets of contacts of relay switch K2. The first set of contacts K2 provides power to timer U7. The control signal is provided to timer U7 via line 66 through U1 (reference numeral 218), U3 (reference numeral 220), and Q2 (reference numeral 222).

The second set of contacts K2 operates the pump motor at an adjustable speed. This is accomplished by connecting the negative motor terminal (terminal 1) directly to one side of the incoming power at terminal 12. The other incoming power terminal (terminal 11) connects to the anode of diode D6. Diode D6, resistor R23, capacitor C14, diode D9, resistor R30, resistor R33, resistor R32, diode D8, resistor R34, and resistor R31 generate and control the rate and duration of pulses applied to the gate G of SCR Q3. These components constitute speed control circuit 70. Power from the input terminal 11 is also applied to the anode of Q3 through a 7.5 OHM 5 watt resistor. When Q3 is gated on, a pulsating DC voltage is supplied to output terminal 2 of the motor. The speed and duration of the pulsating voltage determines the speed of pump motor 72. Speed adjustment control R31 located in dispensing apparatus 40 adjusts the pulsating voltage to thereby adjust the speed of pump motor 72 when operated by the make-up timer U7. The knob can be adjusted during installation to change the amount of make-up detergent added after each rinse cycle. The speed control circuit 70 has no effect on pump motor 72 when operated by pre-charge timer U6.

The logic flowchart of FIG. 2 and the detailed electrical schematic diagram of FIG. 3 represent the best mode presently known to the inventor. However, it will be apparent to those skilled in the art that modifications and variations can be made in the dispensing apparatus and method of the present invention. The invention in its broader aspects is, therefore, not limited to the specific details, representative apparatus, and illustrative examples shown and described above. Thus it is intended that all matter contained in the foregoing description and shown in the accompanying drawings shall be interpreted as illustrative and not in a limiting sense.

In summary, the preferred embodiment of the present invention which is housed in an attractive, rugged, non-metallic enclosure contains the necessary control, chemical feed, and interface circuitry to properly introduce the correct amount of detergent into the warewash machine. A high quality peristaltic pump head, high torque DC motor, and a plug-in solid state electronic control module assure long life and ease of service. The system is a safe, easy to install, low voltage system. Two continuous duty step down transformers are preferably supplied with the system and are designed for mounting at the control panel of the warewash machine to reduce the high voltage present in the machine to the safe 24 VAC required by the system. The first transformer provides continuous electrical power whenever the warewash machine's master power switch is on. The second transformer provides a signal whenever the water control solenoid valve is being activated.

The system continuously monitors the output of the step-down transformer electrically connected to the warewash machine's water control circuit. When the solenoid valve is activated in an initial fill cycle, (after a short delay), the chemical feed pump on the system will operate at high speed until the preset amount of detergent has been pumped into the washtank of the warewash machine. When the water control solenoid valve operates in the rinse portion of a wash cycle, (after a short delay) the chemical feed pump on the system operates at low speed until the preset amount of detergent has been pumped into the washtank of the machine. The dispensing apparatus always knows which water introduction operation the warewash machine is in and feeds the correct amount of detergent accordingly. It also waits until the rinse portion of the wash cycle has ended to inject detergent, thereby eliminating detergent waste due to the skimming action of the water in the washtank during that operation. If for some reason, minor variations in detergent feed are deemed necessary, the amount of detergent introduced into the warewash machine during the rinse cycle can be adjusted by adjusting speed control 70 for pump 48.

The operation of the system is fully automatic and incorporates no user controls. Power to the dispenser is supplied by the warewash machine. When the warewash machine is off, the dispenser is off.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. An apparatus for dispensing detergent in a warewash machine including a washtank for holding a supply of wash water, a rinse water spray head through which water is supplied in a rinse cycle and in a fill cycle, and flow control means for controlling the flow of water being supplied to the warewash machine, the apparatus comprising:

means, coupled with the flow control means, for determining whether the water is being supplied in a fill cycle or a rinse cycle;

means for dispensing detergent to the washtank of the warewash machine;

first control means for operating the dispensing means to dispense a first predetermined amount of detergent, said first control means activated by the determining means in response to a determination that water is being supplied in a fill cycle; and second control means for operating the dispensing means to dispense a second predetermined amount of detergent, said second control means activated by the determining means in response to a determination that water is being supplied in a rinse cycle.

2. The apparatus of claim 1, wherein the second control means causes the second predetermined amount of detergent to be dispensed after the rinse cycle is complete.

3. The apparatus of claim 2, wherein the determining means includes an operation determination timer which is activated upon receipt of a signal from the flow control means and generates a delayed signal after a predetermined time has elapsed.

4. The apparatus of claim 3, wherein said determining means includes a comparator means for receiving the signal generated by the flow control means and the delayed signal generated by the determination timer, the comparator means generating a first control signal to the first control means at times when the flow control means is providing a signal after the predetermined time elapsed and generating a second control signal to the second control means at times when the flow control means is not providing a signal after the predetermined time elapsed.

5. The apparatus of claim 4, wherein the predetermined time is in the range of about 10 to about 20 seconds.

6. The apparatus of claim 1, wherein the detergent dispensing means includes a variable speed pump.

7. The apparatus of claim 6, wherein the pump is a peristaltic pump.

8. The apparatus of claim 1, wherein the first control means includes a pre-charge timer operatively connected to the dispensing means for operating the dispensing means for a first predetermined period of time to pre-charge the washtank with the first predetermined amount of detergent.

9. The apparatus of claim 8, wherein the second control means includes a make-up timer operatively connected to the dispensing means for operating said dispensing means for a second predetermined period of time to add make-up detergent to the washtank.

10. The apparatus of claim 9, wherein the dispensing means is a variable speed pump and the second control means further includes means for controlling the speed of the pump.

11. An apparatus for dispensing detergent in a warewash machine including a washtank for holding a predetermined supply of wash water supplied during a fill cycle, a rinse water spray head for spraying water over a rack of wares and into the washtank during a rinse cycle, and an overflow drain for draining excess water introduced into the washtank during a rinse cycle, the apparatus comprising:

means for determining whether the water is being supplied to the washtank during a fill cycle or a rinse cycle;

means for dispensing detergent to the washtank of the warewash machine;

first control means, coupled with the determining means and the dispensing means, for causing the dispensing means to dispense a first predetermined amount of detergent during or after a fill cycle; and second control means, coupled with the determining means and the dispensing means, for causing the dispensing means to dispense after the rinse cycle is complete a second predetermined amount of detergent to compensate for the detergent drained from the washtank during a rinse cycle.

12. The apparatus of claim 11, wherein the second predetermined amount of detergent is substantially less than the first predetermined amount of detergent.

13. An apparatus for dispensing detergent in a warewash machine including a washtank for holding a supply of wash water and a rinse water spray head through which water is supplied in a rinse cycle and in a fill cycle, the apparatus comprising:

a relay switch operatively connected to the rinse water spray head, said relay switch generating a signal in response to water being supplied through the rinse water spray head;

an operation determination timer for receiving the signal generated by the relay switch, the signal activating the operation determination timer for a predetermined time, said operation determination timer generating a delayed signal after the predetermined time has elapsed;

a control circuit for receiving the delayed signal generated by the operation determination timer and the signal generated by the relay switch;

a variable speed pump for dispensing detergent to the washtank of the warewash machine;

a pre-charge timer operatively connected to the variable speed pump for operating said pump for a first predetermined period of time, the control circuit generating a first control signal to activate the pre-charge timer at times when the relay switch is generating a signal after the predetermined time elapsed; and a make-up timer operatively connected to the variable speed pump for operating said pump for a second predetermined period of time, the control circuit generating a second control signal to activate the make-up timer at times when the relay switch is not generating a signal after the predetermined time, said second control signal being generated after the rinse cycle is complete.

14. The apparatus of claim 13, wherein the variable speed pump is a peristaltic pump.

15. The apparatus of claim 13, further comprising a speed control circuit for adjusting the speed of the variable speed pump at times when it is operated by the make-up timer.

* * * * *